US009588492B2

(12) United States Patent
Roth et al.

(10) Patent No.: US 9,588,492 B2
(45) Date of Patent: Mar. 7, 2017

(54) TIMEPIECE MOVEMENT AND TIMEPIECE INCLUDING SUCH A MOVEMENT

(71) Applicant: GFPI SA, La Chaux-de-Fonds (CH)

(72) Inventors: Dylan Roth, Neuchatel (CH); Stephen Forsey, Les Brenets (CH)

(73) Assignee: GFPI SA, La Chaux-de-Fonds (CH)

( * ) Notice: Subject to any disclaimer, the term of this patent is extended or adjusted under 35 U.S.C. 154(b) by 0 days.

(21) Appl. No.: 15/024,182

(22) PCT Filed: Sep. 8, 2014

(86) PCT No.: PCT/EP2014/069053
§ 371 (c)(1),
(2) Date: Mar. 23, 2016

(87) PCT Pub. No.: WO2015/049090
PCT Pub. Date: Apr. 9, 2015

(65) Prior Publication Data

US 2016/0231708 A1 Aug. 11, 2016

(30) Foreign Application Priority Data

Oct. 3, 2013 (CH) ..... 1697/13

(51) Int. Cl.
*G04B 1/22* (2006.01)
*G04B 13/00* (2006.01)
(Continued)

(52) U.S. Cl.
CPC ..... *G04B 15/14* (2013.01); *G04B 1/16* (2013.01); *G04B 1/225* (2013.01); *G04B 13/008* (2013.01);
(Continued)

(58) Field of Classification Search
CPC ..... G04B 1/16; G04B 1/225; G04B 13/008; G04B 13/028; G04B 15/00; G04B 15/14; G04B 17/27; G04B 17/32
See application file for complete search history.

(56) References Cited

U.S. PATENT DOCUMENTS 7,004,619 B2 * 2/2006 Papi ..... G04B 17/285 368/127
7,350,966 B2 * 4/2008 Zaugg ..... G04B 1/12 368/127
(Continued)

FOREIGN PATENT DOCUMENTS

| | | |
|---|---|---|
| CH | 698622 B1 | 9/2009 |
| EP | 2570870 A1 | 3/2013 |
| WO | 2006099882 A1 | 9/2006 |

*Primary Examiner* — Vit W Miska
(74) *Attorney, Agent, or Firm* — The Webb Law Firm

(57) ABSTRACT

A clockwork movement includes a mechanical energy source, a first regulating part and a first escapement, which are connected by a first gear-train to the energy source, and a second regulating part and a second escapement, which are connected by a second gear-train to the energy source. The first gear-train, the first escapement (4) and the first regulating part (2) define a first assembly. The second gear-train, the second escapement and the second regulating part (10) define a second assembly. At least one differential gear is arranged to provide a kinematic connection between the first assembly and the energy source and between the second assembly and the energy source.

9 Claims, 3 Drawing Sheets

(51) Int. Cl.

| | |
|---|---|
| ***G04B 15/00*** | (2006.01) |
| ***G04B 17/26*** | (2006.01) |
| ***G04B 15/14*** | (2006.01) |
| ***G04B 1/16*** | (2006.01) |
| ***G04B 13/02*** | (2006.01) |
| ***G04B 17/32*** | (2006.01) |

(52) U.S. Cl.
CPC ..... *G04B 13/028* (2013.01); *G04B 15/00* (2013.01); *G04B 17/26* (2013.01); *G04B 17/32* (2013.01)

(56) References Cited

U.S. PATENT DOCUMENTS

| | | | | |
|---|---|---|---|---|
| 8,328,413 | B2 * | 12/2012 | Lechot | G04B 15/00 368/101 |
| 9,081,367 | B2 * | 7/2015 | Forsey | G04B 17/28 |
| 2008/0192583 | A1 * | 8/2008 | Buttet | G04B 17/285 368/127 |

* cited by examiner

TIMEPIECE MOVEMENT AND TIMEPIECE INCLUDING SUCH A MOVEMENT

CROSS-REFERENCE TO RELATED APPLICATIONS

This application is the United States national phase of International Application No. PCT/EP2014/069053 filed Sep. 8, 2014, and claims priority to Swiss Patent Application No. 01697/13 filed Oct. 3, 2013, the disclosures of which are hereby incorporated in their entirety by reference.

BACKGROUND OF THE INVENTION

Field of the Invention

The present invention relates to a timepiece movement, in particular for a mechanical timepiece. More specifically, it relates to a timepiece movement comprising:

a mechanical energy source, a first regulating organ and a first escapement linked by a first gear train to said energy source, the first gear train, the first escapement and the first regulating organ defining a first ensemble, a second regulating organ and a second escapement linked by a second gear train to said energy source, the second gear train, the second escapement and the second regulating organ defining a second ensemble, and a differential gear arranged to provide a kinematic link firstly between the first ensemble and the energy source and secondly between the second ensemble and the energy source.

The present invention also relates to a timepiece comprising such a movement.

Description of the Related Art

A similar movement is in particular described in patent CH 698622. This type of movement incorporating two regulating organs powered by the differential gear described in patent CH 698622 or any other differential gear known from the prior art has certain unwanted effects related to the use of such a differential gear. In particular, when there is a simultaneous impulse on both kinematic chains, one comprising the first ensemble and the other comprising the second ensemble, the energy is first supplied to the kinematic chain that requires least energy. Only after this has occurred will the second chain receive energy. This results in that the energy used to keep the regulating organ of the second chain going is lost. Indeed, since the impulse has already been applied to the regulating organ, the anchor is already in the idle phase. This results in a reduction in the amplitude of the second balance and an increase in the amplitude of the first balance, which has a negative impact on running of the timepiece.

One objective of the present invention is therefore to mitigate this drawback by proposing a timepiece movement that immediately provides each of the two regulating organs with the energy it requires, without disturbing the other regulating organ.

SUMMARY OF THE INVENTION

For this purpose, and according to the present invention, a timepiece movement is proposed, comprising:

a mechanical energy source, a first regulating organ and a first escapement linked by a first gear train to said energy source, the first gear train, the first escapement and the first regulating organ defining a first ensemble, a second regulating organ and a second escapement linked by a second gear train to said energy source, the second gear train, the second escapement and the second regulating organ defining a second ensemble, and at least one differential gear arranged to provide a kinematic link firstly between the first ensemble and the energy source and secondly between the second ensemble and the energy source.

According to the invention, said movement furthermore comprises:

a first spring organ provided between the differential gear and the first escapement and arranged to exert torque on a first output of the differential gear, first means for re-charging said first spring organ, a second spring organ provided between the differential gear and the second escapement, arranged to apply torque to a second output of the differential gear, and second means for re-loading said second spring organ.

The spring organs enable each of the two regulating organs to be immediately supplied with the energy it requires without disturbing the other regulating organ by eliminating the losses or the surplus energy caused by the differential gears known from the prior art.

Preferably, the differential gear may comprise a first transmission wheel and a first output wheel mounted freely in rotation and linked kinematically to the first ensemble, said first spring organ having a first extremity linked to said first output wheel and a second extremity linked to said first transmission wheel.

Preferably, the differential gear may comprise a second transmission wheel and a second output wheel mounted freely in rotation and linked kinematically to the second ensemble, said second spring organ having a first extremity linked to said second output wheel and a second extremity linked to said second transmission wheel.

Advantageously, the first means for re-loading the first spring organ may include a first driving for the first output wheel, said first driving means being rigidly connected to the first transmission wheel.

Advantageously, the second means for re-charging the second spring organ may include second driving means for the second output wheel, said second driving means being rigidly connected to the second transmission wheel.

Advantageously, the differential gear may include an input wheel linked kinematically to the energy source.

Preferably, the input wheel may carry at least one satellite pinion arranged to cooperate with each of the first and second transmission wheels.

Advantageously, each of the first and second spring organs may be a spiral spring.

The present invention also relates to a timepiece comprising a movement as described above.

BRIEF DESCRIPTION OF THE DRAWINGS

The invention will be better understood from the following description, of an embodiment, provided as an example, with reference to the drawings, in which.

DESCRIPTION OF THE INVENTION

Figure 1:
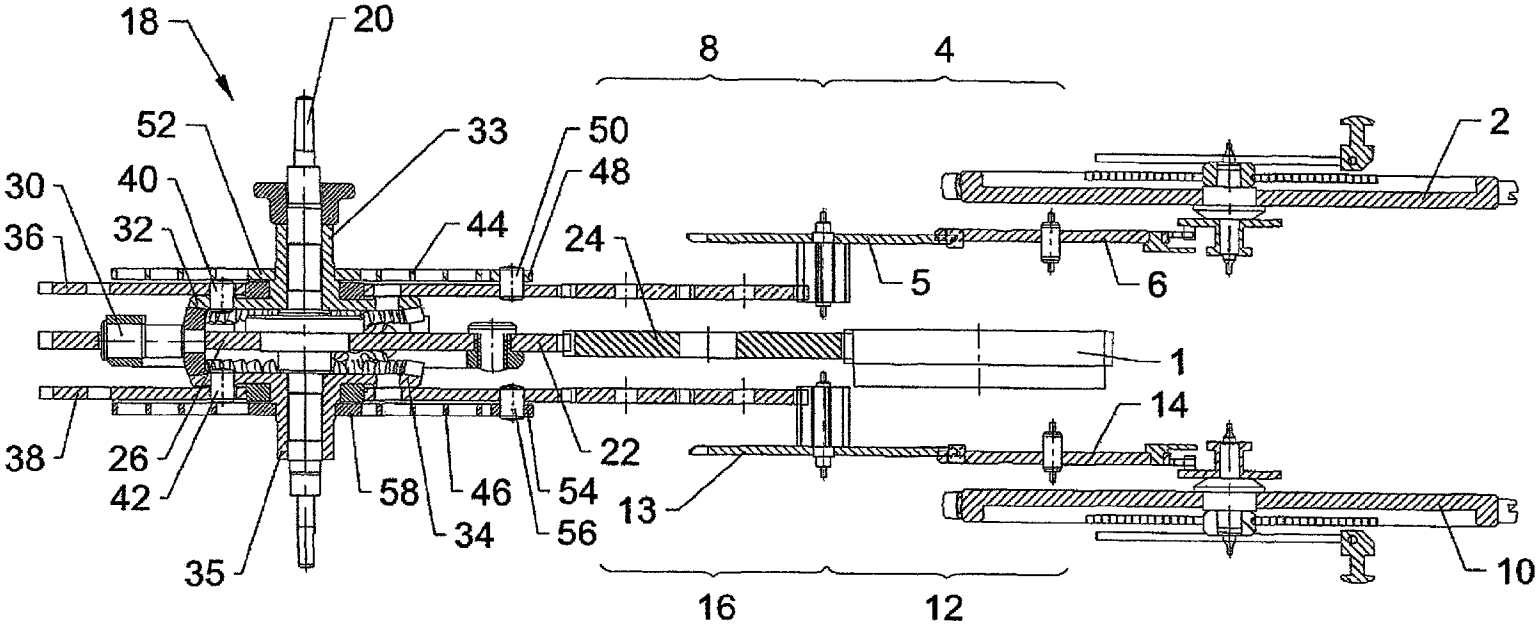
FIG. 1 is a schematic overview of a movement according to the invention.

With reference to FIG. 1, the timepiece movement according to the invention includes in particular:

a mechanical energy source 1, such as a barrel, a first regulating organ 2 and a first escapement 4 comprising a first escapement wheel 5 and a first anchor 6, linked by a first gear train 8 to said energy source 1, the first gear train 8, the first escapement 4 and the first regulating organ 2 defining a first ensemble, a second regulating organ 10 and a second escapement 12 comprising a second escapement wheel 13 and a second anchor 14, linked by a second gear train 16 to said energy source 1, the second gear train 16, the second escapement 12 and the second regulating organ 10 defining a second ensemble, a differential gear 18 arranged to provide a kinematic link firstly between the first ensemble and the energy source 1 and secondly between the second ensemble and the energy source 1.

In the variant shown here, the regulating organs 2 and 10 are simple balances, but it is obvious that they could also be tourbillons or carousels. Furthermore, the first and second escapements shown are Swiss lever escapements, although they could be of another type, such as detent escapements or another known type of escapement.

Figure 2:
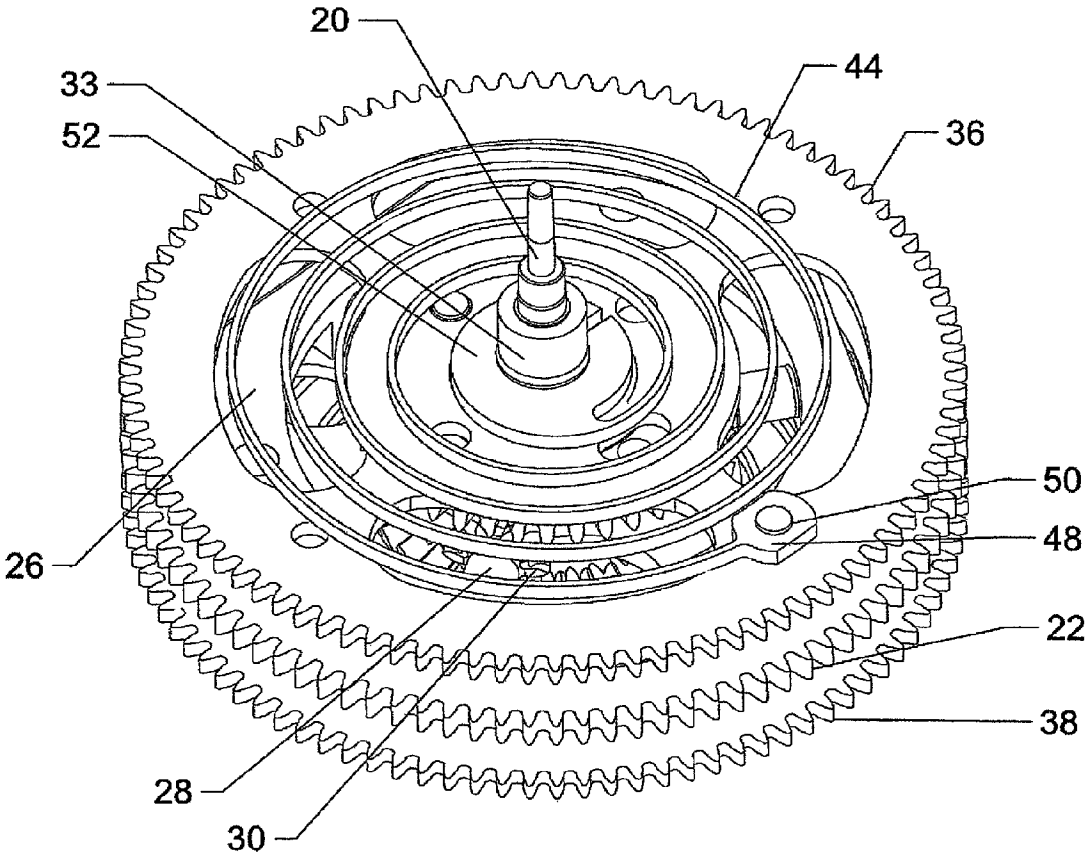
FIG. 2 is an isometric view of the differential gear and of the spring organs used in the invention.
Figure 3:
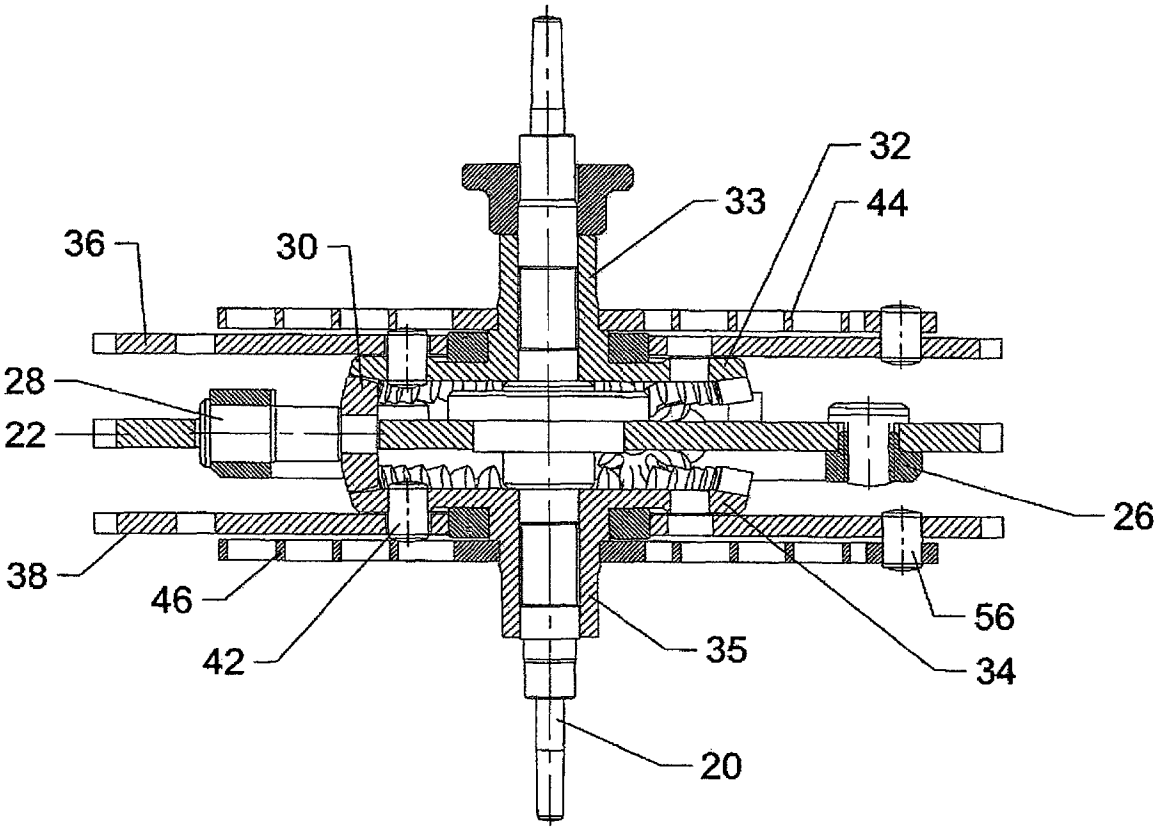
FIG. 3 is a cross-section view of FIG. 2.

With specific reference to FIGS. 2 and 3, the elements making up the differential gear are mounted pivotingly about a shaft 20 rigidly connected to the frame of the movement.

The differential gear 18 includes an input wheel mounted pivotingly about the shaft 20 and having external toothing that meshes with an intermediate wheel 24 that in turn meshes with the energy source 1. It is obvious that the mechanism may include other wheels in addition to the intermediate wheel 24 between the differential gear 18 and the energy source 1.

The input wheel 22 is rigidly connected to a satellite carrier 26 that has shafts 28 perpendicular to the shaft 20, upon each of which is mounted pivotingly a satellite pinion 30. In the variant shown, the satellite pinions 30 have conical toothing.

The differential gear 18 also includes a first transmission wheel 32 and a second transmission wheel 34, respectively mounted pivotingly about the shaft 20 by means of a cannon wheel 33 and 35 respectively. The first and second transmission wheels 32, 34 each have conical toothing arranged on either side of the satellite pinions 30. The conical toothing of the first and second transmission wheels 32, 34 is designed to mesh with the conical toothing of the planetary gears 30.

The first and second transmission wheels 32, 34 shown here are bell wheels, but it is obvious that any transmission wheel of a flat differential may be used. Equally, the shape of the toothing of the planetary gears and of the toothing of the transmission wheels is adapted to the structure of the differential. In particular, the toothings may be straight.

The differential gear 18 also includes a first output wheel 36 and a second output wheel 38, respectively mounted freely in rotation about the shaft 20, and positioned outside the first and second transmission wheels 32, 34 respectively.

The first output wheel 36 has an external toothing meshing with the first gear train 8 and the second output wheel 38 has an external toothing meshing with the second gear train 16.

A first pin 40 is force fitted into the first transmission wheel 32 and inserted with clearance into a hole provided in the first output wheel 36. Equally, a second pin 42 is force fitted into the second transmission wheel 34 and inserted with clearance into a hole provided in the second output wheel 38. The role of these pins 40, 42 is described below.

According to the invention, the movement furthermore comprises:

a first elastic or spring organ 44 provided between the differential gear 18 and the first escapement 4 and charged to exert torque on the first output wheel 36, a second elastic or spring organ 46 provided between the differential gear 18 and the second escapement 12 and charged to exert torque on the second output wheel 38.

More specifically, the first spring organ 44 is positioned outside the first output wheel 36, opposite the first transmission wheel 32, concentric to the shaft 20. It has a first extremity 48 rigidly connected to the first output wheel 36 by means of a pin 50 and a second extremity 52 rigidly connected to the cannon wheel 33 of the first transmission wheel 32.

Equally, the second spring organ 46 is placed outside the second output wheel 38 opposite the second transmission wheel 34, concentric to the shaft 20. It has a first extremity 54 rigidly connected to the second output wheel 38 by means of a pin 56 and a second extremity 58 rigidly connected to the hour wheel 35 of the second transmission wheel 34.

The first and second spring organs can be pre-charged during construction of the movement.

In another structural variant not shown, the first spring organ 44 may be placed inside the first output wheel 36, on the same side as the first transmission wheel 32, and the second spring organ 46 may be placed inside the second output wheel 38, on the same side as the second transmission wheel 34.

In the variant shown, the spring organs 44 and 46 are spiral springs.

Naturally, other variant embodiments are possible, such as replacing the spring and the related output wheel with a wheel incorporating an elastic element. The spring organs or elastic elements may be of any shape (coil, spiral, leaf, etc.) and made of any material, the shape and material being chosen so that said spring organs or elastic elements can store and return energy.

The movement according to the invention functions as follows:

During operation, the motive force supplied from the energy source 1 enters the differential gear 18 via the intermediate wheel 24, the input wheel 22 and the satellite carrier 26 carrying the satellite pinions 30.

When the first and second anchors 6 and 14 release the escapement wheels 5 and 13 respectively, the related output wheels 36 and 38 respectively transmit torque to the respective gear train 8 and 16. Since the spring organs 44 and 46 are pre-charged on their associated output wheels 36 and 38, these latter keep turning as long as they have the possibility. The output wheels 36 and 38 start moving before the transmission wheels 32 and 34. Indeed, the output wheels 36 and 38 are closer to the escapements 4 and 12 than the transmission wheels 32 and 34. Thus, since the force path is shorter to the output wheels 36 and 38, these latter have a quicker reaction time than the transmission wheels 32 and 34.

This mechanism makes it possible to transmit forces to the output wheels 36 and 38 that originate exclusively in the respective spring organs 44 and 46 of same. This transmission also occurs when the impulses from the regulating organs 2 and 10 are simultaneous.

Thus, each regulating organ 2 and 10 instantly receives the energy it requires without disturbing the other. As such, all of the unwanted effects found with the differential gears known in the prior art are eliminated, including when the impulses are simultaneous.

To enable the related spring organ 44, 46 to be recharged, the first and second transmission wheels 32, 34, driven by the energy source 1, recover their lags in relation to the respective output wheels 36, 38. Thus, the initial torque of the spring organs 44 and 46 is restored. Furthermore, the pins 40, 42 act as stops for the transmission wheels 32 and 34 in the output wheels 36, 38 when recovering the lags, to ensure that the related spring organ 44, 46 is always recharged with the same torque.

The cycle can then be repeated.

Naturally, the present invention is not limited to the example embodiment described. Notably, the timepiece movement may include several differential gears arranged sequentially between a main differential gear, positioned closest to the energy source, and the escapement of the first and/or second ensemble. In this case, the first spring organ provided between the main differential gear and the first escapement may more specifically be positioned between the output of the main differential gear and the input of the next cooperating element, i.e. a second differential gear. Equally, the second spring organ provided between the main differential gear and the second escapement may more specifically be positioned between the output of the main differential gear and the input of the next cooperating element, i.e. a third differential gear.

The invention claimed is:

1. A timepiece movement comprising:

a mechanical energy source;

a first regulating organ and a first escapement linked by a first gear train to the energy source, the first gear train, the first escapement and the first regulating organ defining a first ensemble;

a second regulating organ and a second escapement linked by a second gear train to the energy source, the second gear train, the second escapement and the second regulating organ defining a second ensemble;

at least one differential gear arranged to provide a kinematic link firstly between the first ensemble and the energy source and secondly between the second ensemble and the energy source;

a first spring organ provided between the at least one differential gear and the first escapement and arranged to exert torque on a first output of the at least one differential gear;

a first device configured to re-charge the first spring organ;

a second spring organ provided between the at least one differential gear and the second escapement and arranged to apply torque to a second output of the at least one differential gear; and a second device configured to re-charge the second spring organ.

2. The movement according to claim 1, wherein the at least one differential gear comprises a first transmission wheel and a first output wheel mounted freely in rotation and linked kinematically to the first ensemble, and the first spring organ has a first extremity linked to the first output wheel and a second extremity linked to the first transmission wheel.

3. The movement according to claim 2, wherein the at least one differential gear comprises a second transmission wheel and a second output wheel mounted freely in rotation and linked kinematically to the second ensemble, and the second spring organ has a first extremity linked to the second output wheel and a second extremity linked to the second transmission wheel.

4. The movement according to claim 2, wherein the first device configured to re-charge the first spring organ comprises a first driving device for the first output wheel that is rigidly connected to the first transmission wheel.

5. The movement according to claim 3, wherein the second device configured to re-charge the second spring organ comprises a second driving device for the second output wheel that is rigidly connected to the second transmission wheel.

6. The movement according to claim 3, wherein the at least one differential gear further comprises an input wheel linked kinematically to the energy source.

7. The movement according to claim 6, wherein the input wheel carries at least one satellite pinion arranged to cooperate with each of the first and second transmission wheels.

8. The movement according to claim 1, wherein each of the first and second spring organs is a spiral spring.

9. A timepiece comprising a movement according to claim 1.

* * * * *